US011384921B1

(12) United States Patent
Bichon

(10) Patent No.: US 11,384,921 B1
(45) Date of Patent: Jul. 12, 2022

(54) SNOW SHIELD ASSEMBLY FOR USE WITH A TRAFFIC SIGNAL

(71) Applicant: Christopher Neal Bichon, Glenwood Springs, CO (US)

(72) Inventor: Christopher Neal Bichon, Glenwood Springs, CO (US)

( * ) Notice: Subject to any disclaimer, the term of this patent is extended or adjusted under 35 U.S.C. 154(b) by 0 days.

(21) Appl. No.: 17/381,776

(22) Filed: Jul. 21, 2021

(51) Int. Cl.
*F21V 17/06* (2006.01)
*G08G 1/095* (2006.01)

(52) U.S. Cl.
CPC ..... *F21V 17/06* (2013.01); *G08G 1/095* (2013.01)

(58) Field of Classification Search
CPC . G08G 1/095; F21V 17/06; F21V 1/00; F21V 15/00
See application file for complete search history.

(56) References Cited

U.S. PATENT DOCUMENTS 1,711,479 A * 4/1929 Halvorson, Jr. ..... G08G 1/095 D10/115
3,780,285 A * 12/1973 Appeldorn ..... G08G 1/095 362/311.12
4,791,418 A * 12/1988 Kawahara ..... G02F 1/133604 349/61
5,785,418 A 7/1998 Hochstein
9,581,308 B2 2/2017 Watkins
10,223,913 B2 * 3/2019 Bichon ..... G08G 1/095
2005/0243562 A1 * 11/2005 Levin ..... F21V 15/00 362/353
2012/0229672 A1 5/2012 Meyer
2020/0318814 A1 * 10/2020 Wang ..... F21V 29/773

OTHER PUBLICATIONS https://www.fortrantraffic.com/shop/signals/signal-acessories/snow-sentry-snw008/.
https://www.mccain-inc.com/products/signals/signal-accessories/signal-visors.
http://railwaylanternlamp.com/safetran-railroad-train-signal-siemens-cls-20r-large-approx-42h-green-red-light.php.
https://adreama.blogspot.com/2012/06/traffic-light-visor.html.

* cited by examiner

*Primary Examiner* — Julie A Bannan
(74) *Attorney, Agent, or Firm* — Leyendecker & Lemire LLC

(57) ABSTRACT

A snow shield assembly for use with a traffic signal is described. The snow shield assembly typically comprises a shield collar, lens shield, extension ring, and mounting assembly. In some variations, a signal visor may be further included. The snow shield assembly can be retrofit for use with existing traffic signals. The design and configuration of the snow shield assembly creates a gap between the lens shield and the shield collar, providing a second egress for blowing snow in addition to the open bottom portion of the existing signal visor, helping to prevent the obstruction of the signal lens by falling snow. Further, the extension ring permits use on traffic signals having louver covers over the signal lenses.

12 Claims, 5 Drawing Sheets

SNOW SHIELD ASSEMBLY FOR USE WITH A TRAFFIC SIGNAL

CROSS-REFERENCE TO RELATED PATENTS

The present applicant hereby incorporates by reference the entire contents of U.S. Pat. No. 10,223,913.

BACKGROUND

Traffic signals are well known and typically comprise a signal housing having a light source secured therein. Traffic signals are often used at traffic intersections, and typically use a combination of differently colored lights to direct traveling road users and manage the flow of road user traffic through the intersection. Depending on the signal indication (i.e., which colored light is illuminated), a traveling road user facing the traffic signal on an associated street is directed whether to proceed through an intersection (green light), proceed with caution (yellow light), or to stop and not enter the intersection (red light). The ability for road users to clearly see the correct traffic indication is critical in ensuring the safe flow of traffic through an intersection.

Certain circumstances, such as snow storms with high winds, tend to result in a buildup of snow covering the signal lens, obstructing its visibility from road users even when illuminated. In the past, the excess heat generated by the traffic signal's incandescent bulbs would melt off any accumulated snow, maintaining suitable visibility to traveling road users. However, state and federal government regulatory authorities have mandated that old traffic light incandescent bulbs be replaced with light emitting diodes (LEDs) to comply with modern energy efficiency standards.

Not only do LEDs offer increased brightness and better visibility and last longer than incandescent bulbs, LEDs also use significantly less energy. However, because LEDs use so much less energy than incandescent bulbs, LEDs generate much less waste heat in comparison. This means traffic signals equipped with LEDs may not generate sufficient heat to melt accumulating snow, and the signal lens may become completely obscured even when illuminated. As a result, road users traveling through affected intersections are more likely to collide with one another and be seriously injured or killed as a result.

To help ensure sufficient visibility and safety to traveling road users, many traffic signals further include a signal visor disposed around at least the upper portion of its signal lens and extending outwardly therefrom. The signal visor helps shade the illuminated signal lens in bright sunlight and can help prevent the buildup snow and ice over the signal lens. Many of these signal visors include an open bottom portion to help prevent rain and snow from accumulating within the signal visor, which could eventually cover the signal lens and obstruct the signal indication from view. However, due to the vertical orientation of many traffic signal's signal sections, the snow exiting an upper signal section can fall onto and accumulate on the top portion of the adjacent lower signal section, eventually blocking and preventing the egress of snow from the upper signal section's signal visor. In signals using LED lights the problem is compounded because there is insufficient waste heat to melt the retained snow. Certain wind conditions and humidity levels may also push snow upwardly into the signal visor, allowing snow to stick and accumulate within the signal visor and obstruct visibility of the illuminated signal lens as a result. Again this problem is compounded with signals using LED lamps.

Many signals across the country further include louver covers placed over the signal lenses. The louver cover comprises a plurality of evenly spaced, parallel and angled slats that in concert act to reduce of the visibility of light coming from a signal lens and associated lamp. Rather, the light is visible primarily to those who view the lamp from an angle generally parallel to the angle of the visors, which typically comprise road users within a certain distance of the from the signal.

As can be appreciated, when the lamps comprise LEDs that do not generate much waste heat, snow and ice can under certain circumstances accumulate on and between the louvers hindering the visibility of the signal lamp.

DETAILED DESCRIPTION

Figure 1:
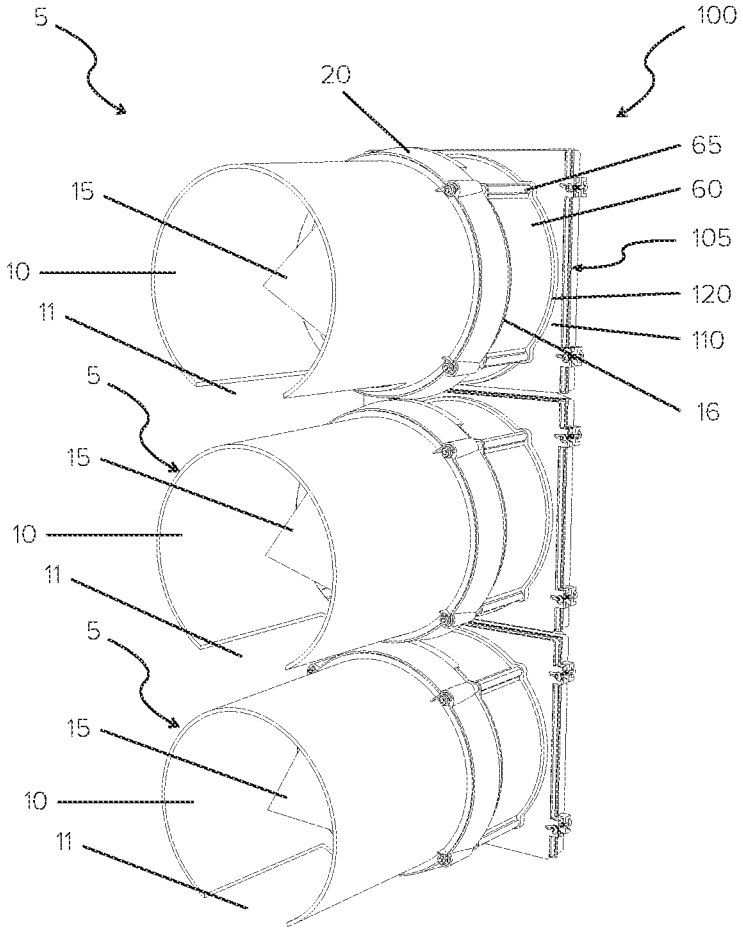
FIG. 1 is a perspective view of a snow shield assembly and traffic signal according to one embodiment of the present invention.

Generally, most embodiments of the present invention include a snow shield assembly for use with a traffic signal having an LED light source. The snow shield assembly typically includes a shield collar, a lens shield, an extension ring, and a mounting assembly. The design and configuration of the snow shield creates a gap between the shield collar and the lens shield, thereby providing an additional egress for blowing snow. The snow shield assembly's configuration helps prevent the buildup of snow and ice over the signal lens and lens shield by directing the wind around the interior of the signal visor and around the lens shield in such a manner as to blow any snow therefrom, preventing snow from settling and accumulating on surfaces that would otherwise obstruct the signal lens. This helps ensure road users maintain suitable visibility of the signal indication during heavy winter storms.

The use of an extension ring that spaces the conical lens shield in front of the lens of a signal section the length of the extension provides space and clearance for traffic signals that utilize louver covers. Essentially, the extension ring's length is sufficient such that the associated louver cover is contained within the extension and does not jut outwardly into the lens shield in a manner that would interfere with mounting the snow shield assembly on a signal section of the traffic signal.

Terminology

The terms and phrases as indicated in quotation marks (" ") in this section are intended to have the meaning ascribed to them in this Terminology section applied to such term throughout this document—including in the claims—unless clearly indicated otherwise in context. Further, as applicable, the stated definitions are to apply, regardless of the word or phrase's case, to the singular and plural variations of the defined word or phrase.

The term "about," as used in this specification and appended claims, refers to plus or minus 20% of the value given.

The term "approximately," as used in this specification and appended claims, refers to plus or minus 10% of the value given.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The terms "generally" and "substantially," as used in this specification and appended claims, mean mostly, or for the most part.

The term "highway," as used in this specification and appended claims, refers to a public way of travel for road users.

The term "or," as used in this specification and the appended claims, is not meant to be exclusive—rather the term is inclusive, meaning either or both.

The term "translucent" as used in this specification and appended claims means permitting light to at least partially pass through. For instance, as used herein, a transparent lens shield would also be a translucent lens shield. A tinted lens shield would also be translucent even though it would not be transparent.

The phrase "road user," as used in this specification and appended claims, refers to a vehicle operator, bicyclists, or pedestrian, including persons with disabilities, on a public roadway or private road open to public travel.

The phrase "signal housing," as used in this specification and appended claims, means the part of a signal section that protects the light source as well as the other necessary components used for display of the signal indication.

The phrase "signal indication," as used in this specification and appended claims, means the illumination of a signal lens or equivalent device.

The phrase "signal lens," as used in this specification and appended claims, means the part of the signal section that redirects the light coming directly from the light source and its reflector, if any.

The phrase "signal section," as used in this specification and appended claims, refers to the assembly of a signal housing, signal lens, and light source, as well as the necessary components to be used for displaying the signal indication.

The phrase "signal visor," as used in this specification and appended claims, means the part of a signal section that directs the signal indication specifically to approaching road users and reduces the effect of direct external light entering the signal lens.

The phrase "traffic control device," as used in this specification and appended claims, means a sign signal, marking, or other device used to regulate, warn, or guide traffic, including road users, placed on, over, or adjacent to a highway or private road open to public travel.

The phrase "traffic signal," as used in this specification and appended claims, refers to a power-operated traffic control device by which a road user is warned or directed to take some specific action.

The phrase "louver cover" as used herein refers to a plurality of a plurality of parallel, and spaced slats contained within a housing that mounts over and extends outwardly from the signal lens. The louver cover acts to reduce the visibility of the light emanating from the lens to intended observers, such as those approaching the traffic signal in a vehicle.

References in the specification to "one embodiment," "an embodiment," "another embodiment," "a preferred embodiment," "an alternative embodiment," "one variation," "a variation," and similar phrases mean that a particular feature, structure, or characteristic described in connection with the embodiment or variation, is included in at least an embodiment or variation of the invention. The phrase "in one embodiment," "in one variation," or similar phrases, as used in various places in the specification, are not necessarily meant to refer to the same embodiment or the same variation.

Directional and relationary terms such as, but not limited to, left, right, nadir, apex, top, bottom, vertical, horizontal, back, front, longitudinal, and lateral are relative to each other and are dependent on the specific orientation of a applicable element or article, and are used accordingly to aid in the description of the various embodiments and are not necessarily intended to be construed as limiting. For instance, traffics signals are known in which the various signal lights are mounted horizontal to each other instead of the more common vertical orientation. The vertically-orientated traffic signal is illustrated herein but it is to be understood that versions and embodiments of the present invention can be used with horizontally orientated traffic signals as well.

A First Embodiment Snow Shield Assembly

A first embodiment snow shield assembly 5 for use with a traffic signal 100 is illustrated in FIGS. 1-5. Typically, the first embodiment snow shield assembly 5 includes a shield collar 20, a lens shield 15, an extension ring 60, and a mounting assembly. The mounting assembly typically comprises a plurality of each of mounting posts 35, standoff sleeves 40, washers 45, and locknuts 50.

Figure 3:
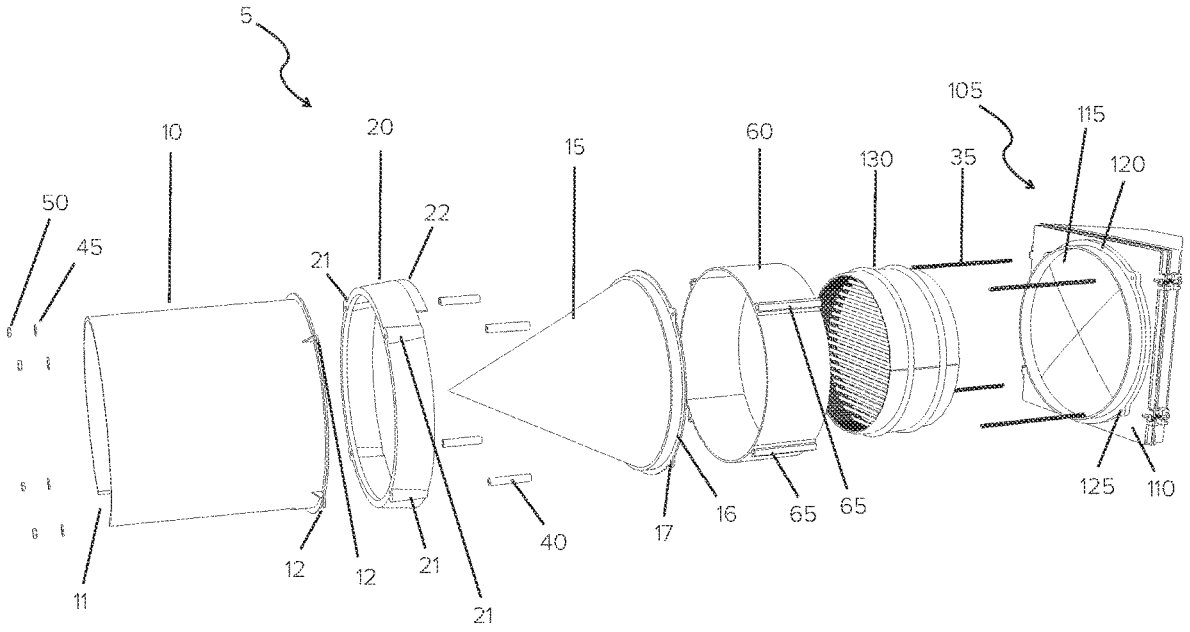
FIG. 3 is an exploded view of a snow shield assembly also showing a signal section according to one embodiment of the present invention.
Figure 4:
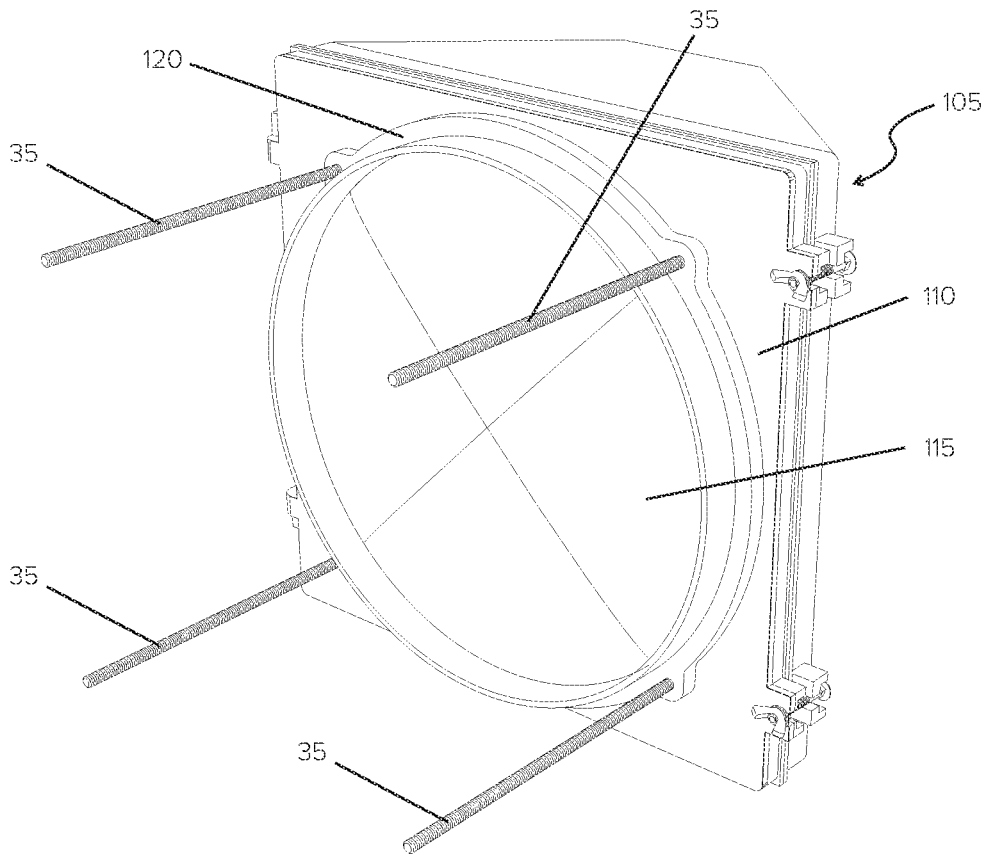
FIG. 4 is a perspective view of a signal section including secured mounting posts according to one embodiment of the present invention.
Figure 5:
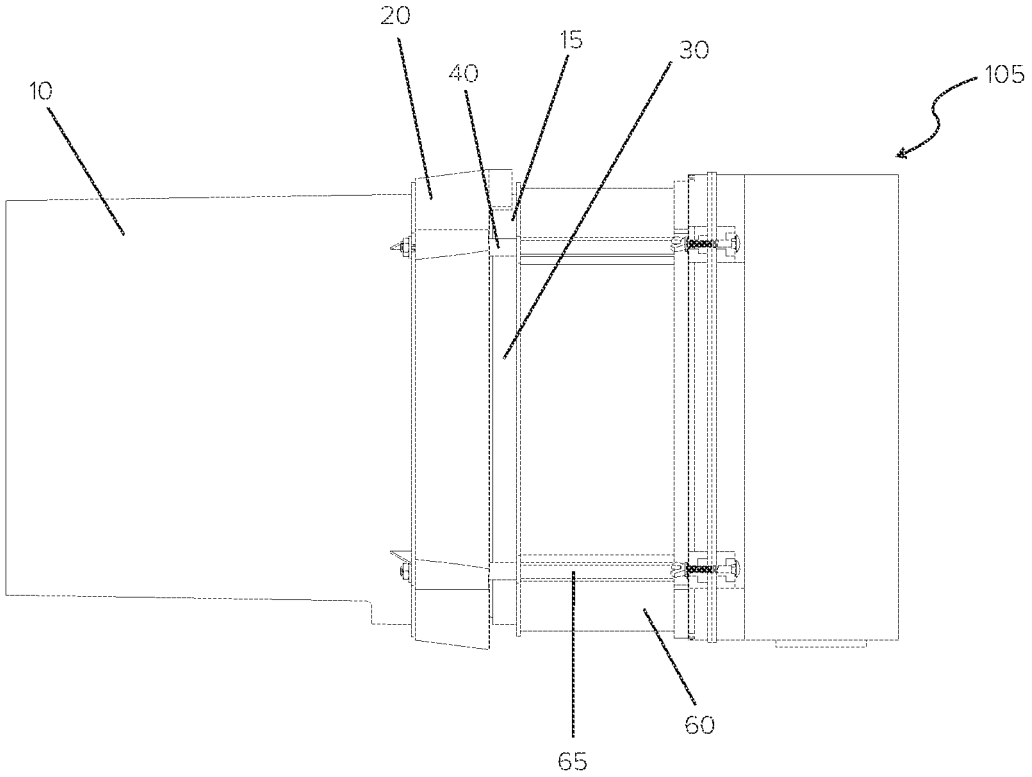
FIG. 5 is a side view of a snow shield assembly coupled with a signal section according to one embodiment of the present invention.

Referring primarily to FIGS. 1 & 3, snow shield assembly 5 for use with a traffic signal 100 is shown. The traffic signal 100 itself can be of a standard or conventional design, and typically comprises one or more signal sections 105, each signal section 105 including a signal housing 110 and a signal lens 115. Often, the traffic signal 100 further includes a signal visor 10 having an open bottom portion 11. The signal housing 110 typically includes an opening for receiving a bulb or lamp therein. The bulb can comprise any suitable light source, but typically comprises an energy efficient light source, such as an array of light emitting diodes (LEDs). In these LED-type traffic signals, the signal lens 115 typically comprises a set of optical lenses, such as a diffuser lens in combination with a Fresnel lens, to realize a specific luminous distribution, giving the LED array a uniform light intensity for better visibility. As shown in FIG. 4, the signal lens 115 covers the light source opening of the signal housing 110 and is typically secured in place with a ring bracket 120.

Figure 2:
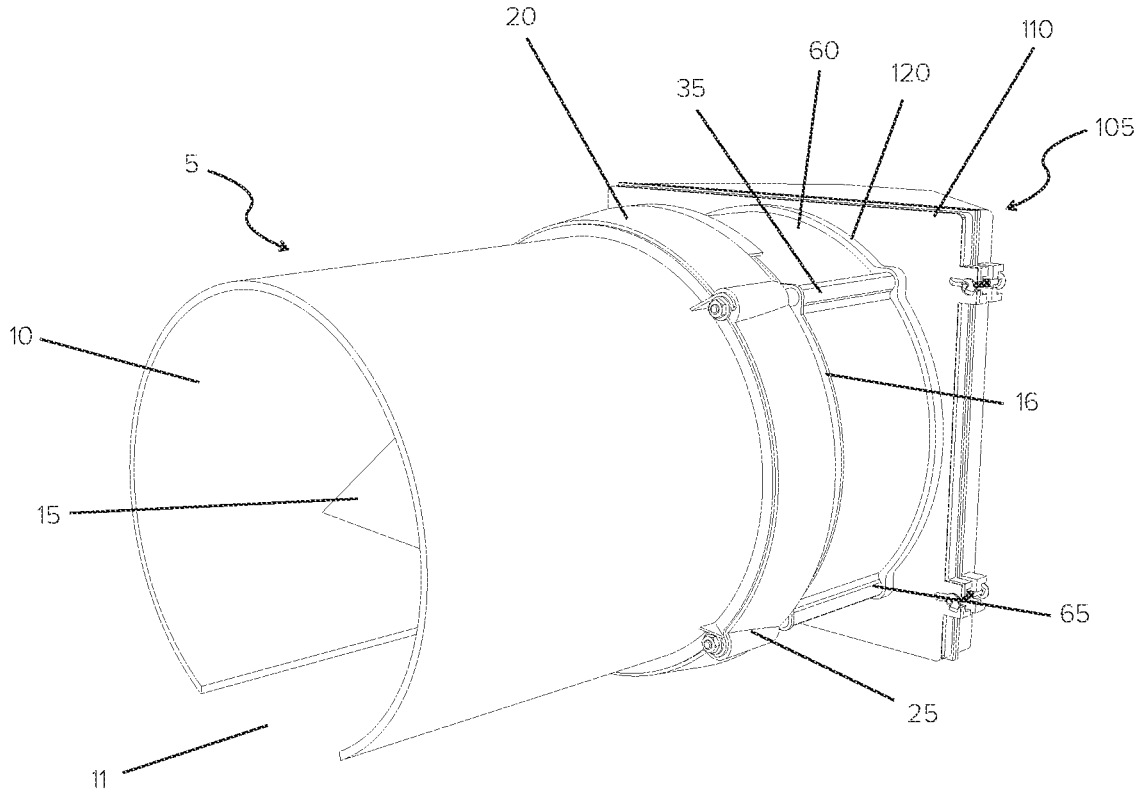
FIG. 2 is a perspective view of a snow shield assembly coupled with a signal section according to one embodiment of the present invention.

Referring to FIG. 2, a snow shield assembly 5 coupled with a signal section 105 is shown. Because the size of signal lens 115 must typically conform with uniform standards, snow shield assembly 5 is configured for retrofit use with most modern traffic signals 100. To install snow shield assembly 5 with an existing traffic signal 100, the existing signal visor 10, if any, is first removed from ring bracket 120. In variations wherein the existing traffic signal 100 does not include a signal visor 10, the snow shield assembly 5 can optionally include a signal visor 10.

With primary reference to FIGS. 3 & 4 the assembly of the snow shield assembly is described herein. Once the signal visor 10 (if so equipped) is removed from the signal section 105, a plurality of mounting posts 35 are secured to the front face (or door) of signal section 105. The mounting posts typically comprise a threaded rod made from a corrosion resistant material, such as stainless steel. In the illustrated embodiment, four mounting posts 35 are threaded into and secured to the signal section 105 at four spaced threaded fastener bores 125 proximate the outside perimeter edge of ring bracket 120. A liquid thread locker or similar adhesive may be used to further secure the mounting post 35 in the bore.

The illustrated signal section is fitted with a louver cover 130 necessitating the use of an extension ring 60 to space the conical lens shield 15 in front of the front face of the louver cover. To install the extension ring, the extension ring mounts 65 comprising elongated bores having diameters greater than that of the mounting posts are slid over respective mounting posts 35 until the back end is received flush with the front face of the signal section.

The extension ring 60 has approximately the same diameter as ring bracket 120, and extends between 4 and 5 inches outwardly from the front face (or door) of signal housing 110. A typical extension ring 60 is approximately 4.25 inches in length. The diameter of extension ring 60 can vary, depending on the diameter of signal lens 115 required by uniform traffic signal standards. In one variation, wherein traffic signal 100 provides for an 11-inch type signal lens 115, extension ring 60 is approximately 12.25 inches in diameter. As shown in FIG. 3 and discussed above, a plurality of the extension ring mounts 65 are disposed the outer perimeter edge of the extension ring 60 with each extension ring mount 65 being arranged and configured to slidably receive a mounting post 35 therethrough. The extension ring 60 typically comprises a lightweight, rigid plastic material.

Next, the conical lens shield 15 is received over the mounting posts through spaced bores 17 in a flange 16 at the base of the lens. The flange sits flush against the front of the extension ring 60. As can be appreciated, since the length of the extension ring is equal or greater than the length of the louver cover, the louver cover does not extend into the hollow interior of the lens shield.

The lens shield is typically comprised of a translucent or transparent plastic material such as polycarbonate, and is most often clear although tinted versions are possible as well. The walls of the conical structure are relatively thin and need only be as thick as necessary to provide structural integrity to the cone. The dimensions of the lens shield can vary, but the diameter is typically set close to if not the same as the diameter of the extension ring and/or the diameter of the signal lens 115 itself. The length of the cone can vary but its length is often dictated by the length of an associated signal visor 10 wherein the tip of the lens shield does not typically extend beyond the outer edge of the visor but is otherwise similar in length.

As shown in FIG. 3, the standoff sleeves 40 are received over the mounting posts 35, and butt against outside of the circumferential flange 16 of the lens shield surrounding the mounting holes 17. The standoff sleeves can be made of any suitable material, such as a rigid plastic or aluminum, and be of any suitable length. The length is dependent on the dimensions of the conical lens shield and the desired gap between the outside surface of the shield and the inside surface of the visor 10.

After standoff sleeves are slid into place, the shield collar mounts 21 of the shield collar 20 with bores therethrough are slid onto the mounting posts 35 until seated against ends of the standoff sleeves. The standoff collar sleeves 40 space the backend end of the shield collar 20 a predetermined distance away from the circumferential flange of the lens shield 15 creating a gap 30 between the circumferential flange of the lens shield and the backend of the shield collar. This space permits air entering the signal section at the front of the visor 10 to travel rearwardly and then be directed by the surface conical lens shield and the inside surface of the visor rearwardly and out the gap. In at least come variations the shield collar can be frustoconical in shape such the the rear end of the collar has a slightly greater diameter than the extension ring 60 and flange 16 of the lens shield behind it. This helps increase the size of the gap 30, and accordingly, the effectiveness of the gap in helping clear snow.

As shown in FIG. 3, the shield collar 20 includes an arcuate tab 22 radially disposed along a portion of the rear or back perimeter edge of extension ring 20, and extending rearwardly therefrom. When the snow shield assembly 5 is coupled with a signal section 105, the arcuate tab 22 is positioned proximate the top portion of traffic signal 100 facing generally upwardly. This helps prevent generally downwardly falling snow from entering gap 30 accumulating around lens shield 15.

After the shield collar 20 is received into place, the signal visor 10 is received over the mounting posts 35. As shown in FIG. 2, signal visor 10 includes a plurality of through holes (or slots) 12 disposed along its outside perimeter edge for receiving the respective mounting posts therethrough. Signal visor 10 can be made of any suitable material, but typically comprises a lightweight material such as a corrosion resistant aluminum or a rigid plastic.

Typically, signal visor 10 is also typically mildly frustoconical in shape, having an open bottom portion 11, as shown in FIG. 4. The conical shape of lens shield 15 acting in concert with the inside wall portion of signal visor 10 causes the speed of any snow entering into signal visor 10 to increase in speed as the snow moves from the proximate end of signal visor 10 towards its distal end, reducing the possibility of snow settling on and accumulating on the surface of the signal lens 105 or the inside wall of signal visor 10. The snow's increased speed also increases the pressure at the distal end of signal visor 10, pushing the snow out through its open bottom portion 11 or through gap 30 between the signal visor 10 and the signal lens 115 and into the lower pressure region on the outside of the snow shield assembly 5.

To secure the snow shield assembly in place washers 45 and locknuts 50 are threaded over the ends of the mounting posts 35, and the locknuts 50 are tightened to secure the stack of snow shield assembly components in place.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

For instance, traffic control devices can vary in shape and in size, depending on the particular size and shape dictated by current uniform traffic signal standards. For example, in other variations not shown, a traffic control device for directing pedestrian travel includes a square-shaped signal lens. In variations wherein a square-shaped signal lens is required, lens shield can be pyramidal in shape and include a square-shaped flange extending from its distal outer edge. Similar to the preferred embodiment illustrated in FIG. 3, the flange mounting holes are structured and arranged to removably receive the mounting posts therein. In these variations, shield collar and extension ring are similarly structured and arranged to couple with a square-shaped signal lens.

I claim:

1. A snow shield assembly for a traffic signal having a signal section including a signal lens and a louver cover mounted in front of the signal lens, the snow shield assembly comprising:

a extension ring configured to couple with the signal section, the extension ring having a circumferential wall configured to encircle the signal lens, the radial wall extending outwardly therefrom for a predetermined length;

a cone-shaped translucent lens shield having a lens shield flange at a base thereof configured to couple with the extension ring;

a ring-shaped shield collar configured to couple with the lens shield, wherein a gap is provided between a back edge of the shield collar and the lens shield flange; and a mounting assembly, the mounting assembly including a plurality of elongated mounting posts configured to be threadably secured to the signal section and extend outwardly through the extension ring, the lens shield flange and the shield collar to couple the snow shield assembly securely together.

2. The snow shield assembly of claim 1 further comprising a plurality of standoff sleeves, the standoff sleeves having longitudinal bores and being configured for receipt over the mounting posts between the flange of the lens shield and the shield collar to space the flange and the shield collar and create the gap.

3. The snow shield assembly of claim 2, further comprising a signal visor, the signal visor being configured to attach to the shield collar and be secured in place by the mounting assembly.

4. A combination comprising the traffic signal and the snow shield assembly of claim 1, wherein the snow shield assembly is secured to the signal section.

5. A combination comprising the traffic signal and the snow shield assembly of claim 3, wherein the snow shield assembly is secured to the signal section.

6. The combination of claim 5, wherein the predetermined length is equal to or less than a length of the louver cover.

7. The snow shield assembly of claim 1, wherein the predetermined length is about three to five inches in length.

8. The snow shield assembly of claim 1, wherein the extension ring is between 8 and 12 inches in diameter.

9. The snow shield assembly of claim 1, wherein the extension ring comprises a rigid plastic material.

10. The snow shield assembly of claim 1, wherein the extension ring comprises a metal.

11. The snow shield assembly of claim 3, wherein the extension ring includes a plurality of longitudinally extending extension ring mounts equally spaced from each other on an exterior surface of the extension ring, the extension ring mounts having longitudinal bores with a diameters greater than a diameter of the elongated mounting posts.

12. A method of installing the snow shield assembly of claim 11 on the traffic signal, the method comprising:

threading each of the plurality of mounting posts into a threaded fastener bore of the signal section;

simultaneously sliding the longitudinal bores of the extension ring mounts over the mounting posts until a first end of the extension ring is seated against the signal section;

sliding the spaced bores on the flange of the lens shield over the mounting posts until the flange is seated against a second end of the extension ring;

sliding the standoff sleeves over the mounting posts until the ends thereof abut the flange of the lens shield;

sliding the shield collar mounts over the mounting posts until back edge of the shield collar abuts the front end of the standoff sleeves causing a gap between the lens shield flange and the back edge of the shield collar;

receiving a signal visor over the mounting posts until it abuts the front edge of the shield collar; and receiving a washer and a locknut over the mounting posts and tightening the locknut to secure a stack comprising the extension ring, the lens shield, the standoff sleeves, the shield collar, and the signal visor securely in place on the signal section of the traffic signal.

* * * * *